US010124577B2

(12) United States Patent
Soriano Fosas et al.

(10) Patent No.: US 10,124,577 B2
(45) Date of Patent: Nov. 13, 2018

(54) PRINTER POWER USAGE

(71) Applicant: Hewlett-Packard Development Company, L.P., Houston, TX (US)

(72) Inventors: David Soriano Fosas, Vancouver, WA (US); Ignacio Soler Flores, Sant Cugat del Valles (ES); Marc Soler Jauma, Sant Cugat del Valles (ES); Jose Francisco Bravo de Vega, Sant Cugat del Valles (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/316,676

(22) PCT Filed: Jun. 6, 2014

(86) PCT No.: PCT/EP2014/061876
§ 371 (c)(1),
(2) Date: Dec. 6, 2016

(87) PCT Pub. No.: WO2015/185163
PCT Pub. Date: Dec. 10, 2015

(65) Prior Publication Data

US 2017/0144432 A1 May 25, 2017

(51) Int. Cl.
*B41J 29/38* (2006.01)
*B41J 2/01* (2006.01)
(Continued)

(52) U.S. Cl.
CPC ..... *B41J 2/01* (2013.01); *B41J 23/32* (2013.01); *G03G 15/5004* (2013.01)

(58) Field of Classification Search
USPC ..... 347/5, 9, 19; 358/1.15
See application file for complete search history.

(56) References Cited

U.S. PATENT DOCUMENTS 6,891,556 B2 5/2005 Sasaki et al.
6,971,731 B2 12/2005 Brenner et al.
(Continued)

FOREIGN PATENT DOCUMENTS

JP 2010162742 7/2010
JP 2010219621 9/2010
JP 2011199627 10/2011

OTHER PUBLICATIONS

Minimizing the Power Consumption of IT Equipment, Author Unknown, http://www.physics.ox.ac.uk/it/general/powersaving.htm >.

*Primary Examiner* — Lam Nguyen
(74) *Attorney, Agent, or Firm* — HP Inc. Patent Department

(57) ABSTRACT

Methods and apparatus for assessing power usage of at least one printer component in a printer are described. For example, based on a print instruction (the print instruction being to cause the printer to carry out a printing task), power usage requirements of the at least one printer component in carrying out the print instruction may be determined. The power usage may be determined for each of a plurality of time intervals. In some examples, the effect of the printer component(s) in carrying out the print instruction on at least one power quality measure associated with a power supply network which may be connected to the printer may be considered.

20 Claims, 4 Drawing Sheets

(51) Int. Cl.
*G03G 15/00* (2006.01)
*B41J 23/32* (2006.01)

(56) References Cited

U.S. PATENT DOCUMENTS

2011/0304876 A1* 12/2011 Coffey ..... G03G 15/5004 358/1.15
2013/0093813 A1 4/2013 Davis et al.

* cited by examiner

PRINTER POWER USAGE

BACKGROUND

Printers may be connected to an electrical supply network, and draw power therefrom.

DETAILED DESCRIPTION

When electrical equipment draws a current, it can impact power quality in the local electrical supply. One effect is generally known as 'flicker' as it can cause an appreciable change in brightness of incandescent light bulbs. Such flicker can be irritating, and the varying power supply can cause issues for other sensitive equipment. Therefore, power quality standards, such as the International Electrotechnical Commission (IEC) 61000-3-3 flicker standard, have been developed. A related standard, IEC-61000-4-15, provides functional and design specifications for flicker measuring apparatus to evaluate flicker severity. Such apparatus records voltage and/or power fluctuations and derives one or both of a short-term and a long term flicker indication, which can then be compared to predetermined values to see whether equipment under test meets a desired standard. The IEC standards mentioned above are incorporated by reference to the fullest extent allowable.

Due to the nature of operation, the power consumption by at least some of the subsystems in a printer tends to be cyclical, and a number of subsystems within a printer may draw significant power (e.g. greater than about 100 W). Both of these factors may contribute to the chances of causing flicker. However, determining flicker according to IEC analysis requires a complicated algorithm beyond the processing capabilities of some printers. In addition, if the voltage of the various subsystems is to be monitored directly, this can require voltmeters and other apparatus, adding to the complexity of a printer.

Figure 1:
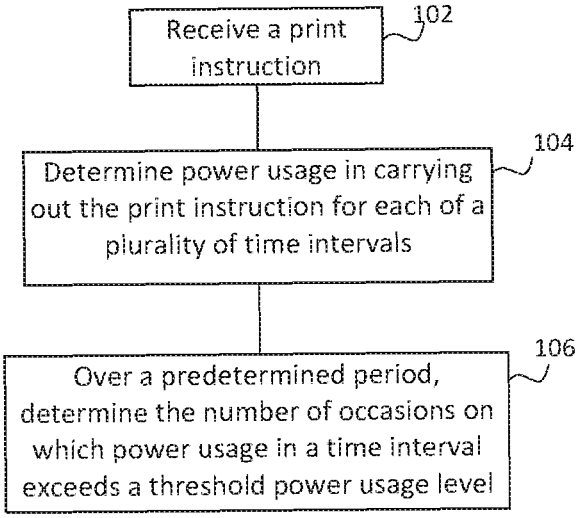
FIG. 1 is an example of a method for assessing the power usage of a printer.

FIG. 1 is an example of a method for assessing the power usage of at least one printer component. In block 102, a print instruction is received. The print instruction is to cause the printer to carry out a printing task. To that end, the print instruction may, for example, comprise a representation of a file to be printed and comprise instructions intended to be conveyed to printheads of a printer. Such instructions may, for example, be arranged to cause and coordinate printer actions (such as, depending on the type of printer, firing of ejector nozzles, controlling a laser, etc) to produce a desired printed pattern, which may be an image, text or the like, and may be provided in the form of a computer readable file, such a Portable Document Format (PDF) file or Tagged Image File Format (TIFF) file or the like.

In block 104, the print instruction is used to determine a power usage for at least one printer component in carrying out the print instruction. The power usage is determined for each of a plurality of time intervals, the time intervals corresponding to portions of the time taken to carry out the printing task. In block 106, the number of occasions on which the power usage in a time interval exceeds a threshold power usage level within a time period is determined.

Figure 2:
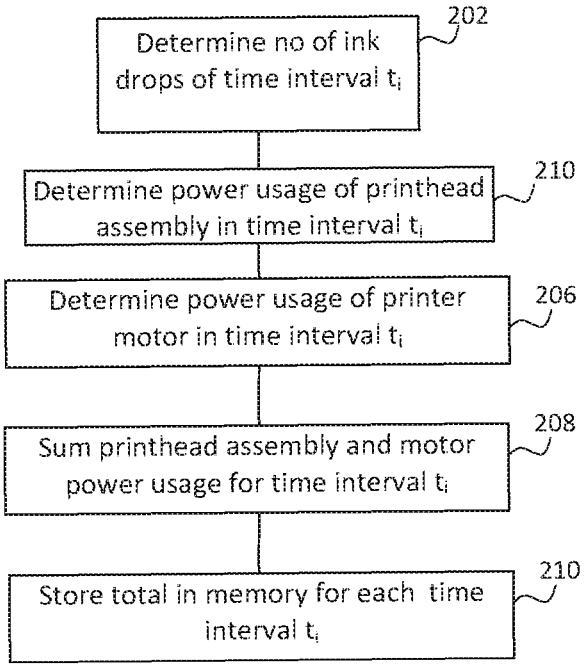
FIG. 2 is an example of a method for assessing the power usage of a printer in a time interval.
Figure 3A:
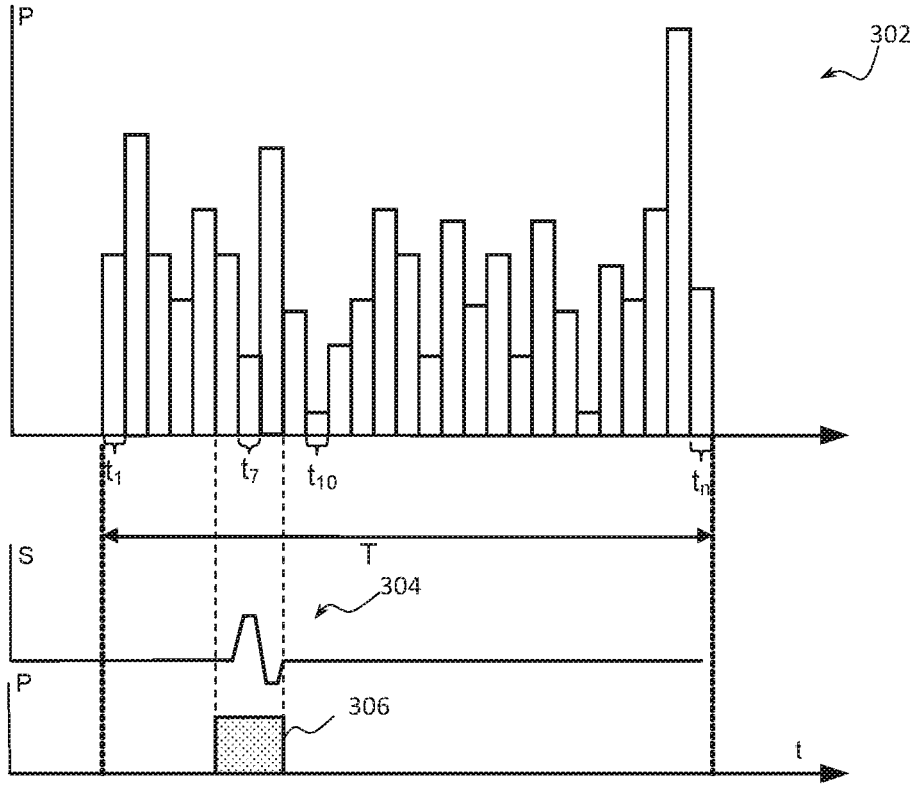
FIGS. 3A and 3B show examples of the power usage of a printer over a period of time.
Figure 3B:
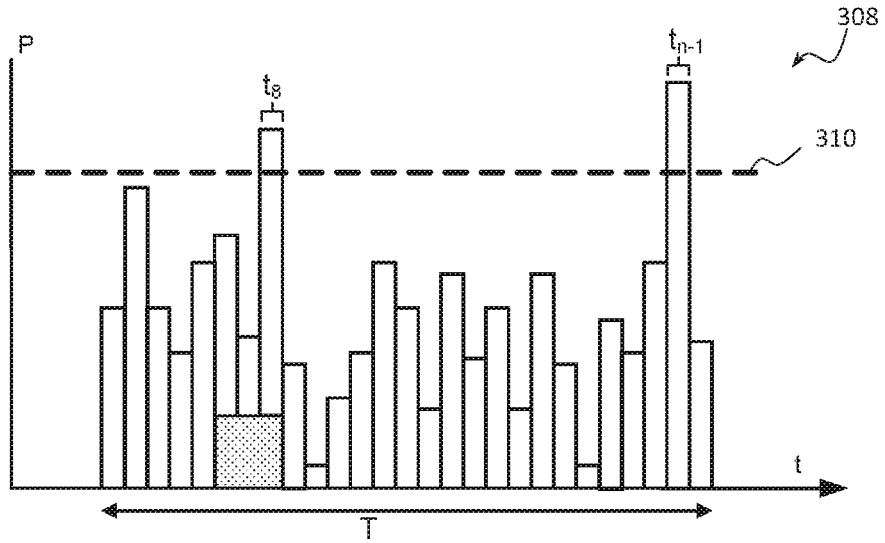

One method of determining the power usages as mentioned in relation to block 104 is further described in relation to the flowchart of FIG. 2, as well as FIGS. 3A and 3B.

Figure 4:
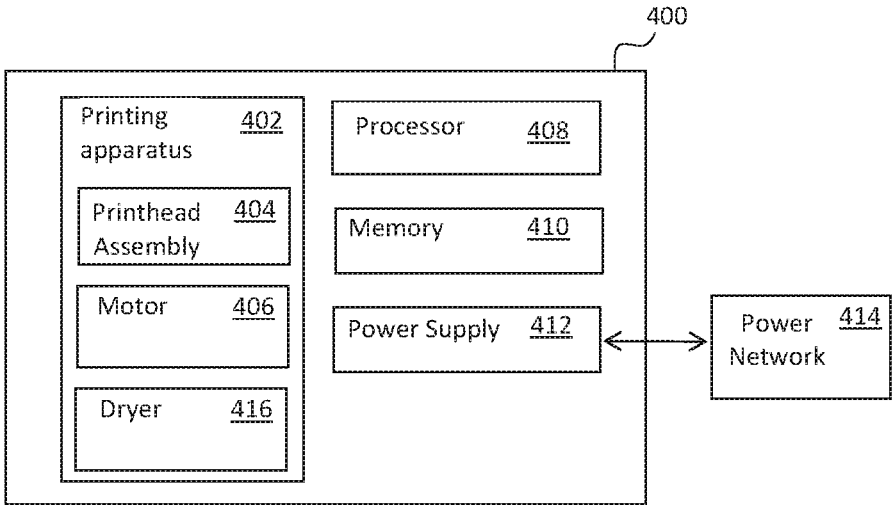
FIG. 4 is a schematic representation of a printer connected to an electrical supply network, according to one example.

FIGS. 3A and 3B show examples of power usage in a time period. A schematic representation of an example of an inkjet printer 400 is shown in FIG. 4. The printer 400 comprises printing apparatus 402, in turn comprising a printhead assembly 404 and a printer motor 406, which in this example is a substrate feed motor. The printhead assembly 404 comprises at least one printhead arranged to eject drops of ink to be printed on a substrate under the control of a processor 408. The printer 400 further comprises a memory 410 and power supply 412. In this example, the power supply 412 is connected to a electrical power supply network 414, which provides power to the printer 400. The printer 400 further comprises, as part of the printing apparatus 402, a dryer 416, arranged to dry the ink once it has been applied a substrate.

Such a printer 400 may further comprise additional components not illustrated for the sake of simplicity. Such components may for example comprise drum(s), cleaners to clean the drum(s), heaters, rollers or other conveyers for conveying the substrate, a supply of substrates, user interfaces, and the like. The power usage of any or all such components may be assessed, either using processes as set out herein, or using alternative methods. Where the power requirements of a component are low or steady and/or they are unlikely to have a significant effect on network power quality by causing flicker or the like, the effect of such components on power quality may be ignored.

Figure 5:
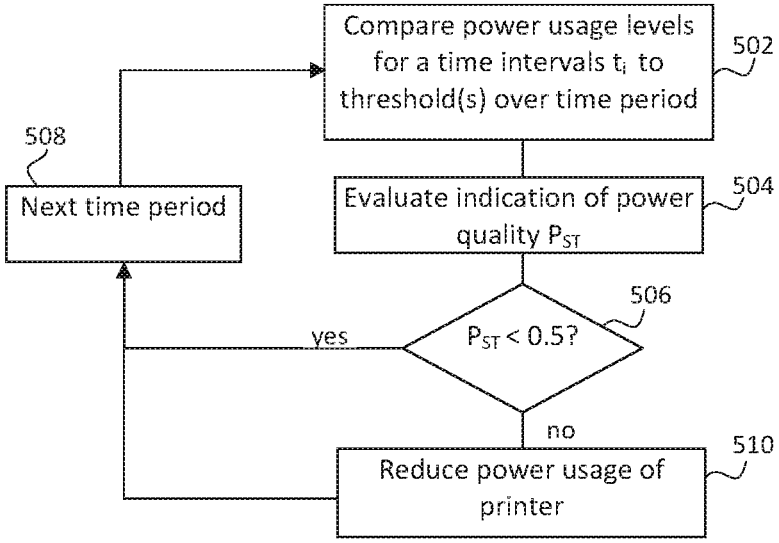
FIG. 5 is an example of a method for determining if a printer has a detrimental effect on the power quality of an electrical network.

In this example, the effect of two printer components (specifically, in this example, the printhead assembly 404 and the printer motor 406) on the network power quality is modeled by the processor 408, which may, for example, carry out the processes set out in FIGS. 1, 2 and 5. The effect of another printer component (in this example, the dryer 416) is considered using a separate process as set out below.

The number of drops of ink that are to be ejected in a given time interval will vary throughout the printing task, in accordance with the image portion that is to be printed onto the substrate over a given interval. The power usage for a printhead assembly 404 of an inkjet printer 400 for each time interval may be determined based on the number of ink drops ejected in that time interval. Indeed, in this example, each ink drop of a given color is taken to correspond to a given amount of power utilized by the inkjet-printing mechanism, such that the total power utilized is related to the number and color of drops (i.e. in this example, a drop of a particular color may relate to a higher power consumption than a drop of a different color). This information is supplied as part of a print instruction, which may comprise, for example, a computer readable file such as a pdf or TIFF file, and can be related to power consumption of the component for example via a look up table, or computed on the fly.

Therefore, in order to determine the power usage in a time interval $t_i$, first, the number of ink drops of each color to be ejected onto substrate in the time interval is determined by reference to the print instruction (block 202). In this example, the time interval $t_i$ is less than the time taken to complete the printing job, T. In one particular example, T may be about 2 seconds. In other examples, this could be any predetermined value. The number n of intervals (and therefore the length of $t_i$) depends on the plot length and other factors.

The power required to eject the drops in each time interval is determined (block 204), as shown in FIG. 3A in the bar chart 302, in which time is shown on the horizontal axis and power on the vertical axis. Each bar therefore represents the power used (or to be used) by the printhead assembly 404 in carrying out the print instruction for each of a plurality of time intervals $t_i$, for i=1 to n, where $$\sum_{i=1}^{n} t_i = T.$$

In this example, the time intervals $t_i$ are of equal duration but this need not be the case.

Next, the power usage of the motor 406 is considered. Based on the print instructions, which may include, for example, how many pages are to be printed (in the example of FIG. 3A, this is a single page) and the torque S of the motor 406 (or the current, which is proportional the torque in a DC motor) (shown in FIG. 3A at 304), the sum of the power used to drive the motor 406 in each time interval $t_i$ is determined, as shown in FIG. 3A at 306 (block 206). In this example, the motor 406 only operates for a short time period, over intervals $t_7$ to $t_9$, and otherwise the motor 406 is not drawing power in the time period T.

The total of the printhead assembly power and the motor power is then summed for each time interval (block 208). This can also be seen in the bar chart 308 of FIG. 3B, where the motor power usage corresponding to $t_7$ to $t_9$ have been added to the printhead assembly power usage to produce a total power usage.

This value, for each $t_i$, is stored in the memory 410 (block 210).

Also shown in FIG. 3B is an indication of a threshold power level 310. Over the time period T, this threshold is exceeded twice, at $t_8$ and $t_{n-1}$. In this example, the threshold power level 310 is indicative of a change in power consumption which is likely to cause flicker, i.e. if there is a change of power consumption from zero to the value of the threshold, the probability of causing flicker is high.

Flicker is an effect experienced by other equipment connected to the electrical power supply network 414. For example, light bulbs in the same or nearby rooms may noticeably dim as the power drawn by the printer 400 exceeds a threshold. In addition, flicker reduces the power quality and can damage some electrical equipment.

An example of an acceptable level of voltage variation has been specified by the IEC, although other levels may be appropriate in other circumstances. The IEC standards evaluate of two categories of flicker severity: short-term (over a 10 minute period) and long-term (over a longer period, related to the duty cycle of the apparatus causing the flicker, typically 2 hours). These are evaluated by the parameters $P_{ST}$ and $P_{LT}$ respectively. If a machine (as may be the case for a printer) has a short duty cycle, the long-term severity can be computed by measuring the shot-term severity value while it is working and the rest as if the printer is in stand-by mode, which means that the power consumption is very little.

Due to their relatively short duty cycle, short-term evaluation of flicker severity, $P_{ST}$, may be the more relevant measure for printers (although long term flicker severity, $P_{LT}$, or any other quality measure, may also be considered). As defined by the IEC, the determination of flicker severity considers the proportion of time for which various power thresholds are exceeded.

In this example, the proportion of time intervals for which the various power thresholds defined by the IEC standards are used to determine $P_{ST}$. The value of these thresholds will depend on the power usage levels determined for the time period. However, in other examples, different thresholds may be used. For example, a difference in power levels within a predetermined number of time intervals may be considered. This is because relatively large changes in power consumption over relatively short periods of time contribute to the risk of flicker. For example, if there is change in power consumption of a predetermined amount (for example, of about 400 W), and this change is seen within a predetermined number of time intervals (for example, within 5 time intervals), then this may be indicative of the risk of flicker. In some examples, therefore, the threshold(s) may depend on other data collected in the time period.

The IEC standard level for 'non-objectionable' flicker is set at $P_{ST} \leq 51.0$, $P_{LT} \leq 0.65$, although other standards may be applied.

FIG. 5 is a flow chart of a method for determining whether the printer 400 causes, or would cause, an adverse effect on power quality (in this example, voltage flicker) in the connected power supply network 414. In this example, if the adverse effect exceeds a threshold level (in this case, set with reference to $P_{ST}$), this is deemed to be a significant degradation and remedial action is taken regarding operation of the printer 400.

In step 502, the power usage levels for a time interval $t_i$ stored in the memory 410 are retrieved and compared by the processor 408 to at least one threshold level, for all the time intervals in a time period T. As the measure being considered in this example is $P_{ST}$, the time period is 10 minutes, but other time periods may be used. In this example, in order to evaluate $P_{ST}$, the methods set out standard IEC 61000-4-15 are used. This comprises the determination of the proportions of time intervals for which various threshold are exceeded, which proportions are combined to provide $P_{ST}$.

Evaluating flicker can comprise monitoring a voltage signal directly, which can comprise using voltmeters, filters, demodulators and the like to separate the modulating signal from the main voltage signal. Use of demodulators usually results in unwanted artefacts in the data, which are generally removed with a further processing step. This data is then used to create a probability density function. However, in the examples set out herein, the actual voltage signal may not be acquired (or may not be acquired for all subsystems or components contributing to the change in voltage quality).

In the example of FIG. 5, the next step is to evaluate a power quality measure which in this example is $P_{ST}$ (block 504). In block 506, the power quality measure is compared to a desired measure. According to IEC standards, so long as $P_{ST} \leq 1$, this is acceptable. However, in order to allow for a margin of error, and for other fluctuating loads which may contribute to flicker, in this example, the acceptable level of contribution from the motors and the printhead assembly is set to $P_{ST} < 0.5$.

In one example, the printer 400 may have further demands on the power supply network 414. For example, the printer 400 may comprise at least one component or subsystem which have a power usage profile which is not modelled as part of the process outlined herein.

In this example, the printer 400 comprises a dryer 416, which is self regulating through use of an embedded resistor switching algorithm to a threshold contribution to flicker of $P_{ST}<0.3$. Therefore a reasonable threshold for the contribution from the motors and the printhead assembly is set as $P_{ST}<0.5$. Of course, other thresholds may be applied depending for example on any other equipment affecting or affected by power quality in the connected supply network 414.

Returning to FIG. 5, If $P_{ST}<0.5$, i.e. the adverse effect on the power quality due to the considered printer components does not (or would not) exceed acceptable levels for that period, the next time period is considered (block 508). The time periods may be overlapping, for example with a start time offset from one another by one or more time intervals $t_i$. However, in other examples, the time periods may be contiguous, but non-overlapping, or may be discrete with an interval therebetween.

If $P_{ST}>0.5$, i.e. the adverse effect on the power quality due to the considered printer components does or would exceed acceptable levels for that period, the possible degradation to power quality is considered to be significant and the power usage of the printer 400 is reduced (block 510). In this example, this comprises operating the printer at a reduced speed. This therefore results in a reduction of the power requirements in each time interval $t_i$, reducing any (or any possible) detrimental effect of the printer on power quality in the network 414. In another example, the power usage may be reduced by pausing the printer for time, for example a few seconds.

The printer 400 may for example enter a 'flicker control mode', in which a predetermined speed reduction, or else a reduction in speed to a predetermined level, is employed. A first stage reduction may be implemented and, if this proves insufficient to reduce the adverse effects of the printer, a further reduction, which may include pausing the printer 400, may be implemented. The pause may be, for example, one to a few seconds in length. In addition, the reduction in printer speed may result in a change of the timing of repetitive power use patterns, which could also have benefits in reducing the effects of flicker.

Such a speed reduction or pause decreases the throughput of the printer 400, which may be contrary to a user's preferences. Therefore, the threshold/printer 400 may be arranged such that the threshold is exceeded only rarely, such that such a decrease in throughput is not unduly troublesome. Indeed, it may be that power quality issues are only seen when printing images with certain print patterns, producing ink consumption at characteristic frequencies, and therefore may occur relatively rarely.

Figure 6:
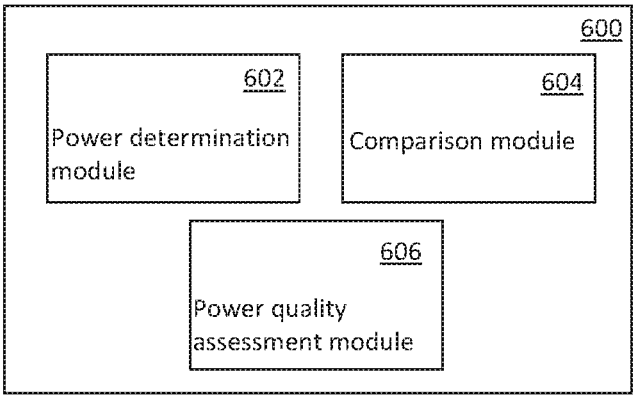
FIGS. 6 and 7 are schematic representations of processors, according to examples.

FIG. 6 shows a power monitor 600 for a printer comprising a power determination module 602, a comparison module 604, and a power quality assessment module 606. The power determination module 602 is to determine the power usage requirements of at least one printer component in carrying out a print instruction, and to determine a power usage level for each of a plurality of time intervals. The comparison module 604 is to compare the power usage levels to at least one threshold. In one example, the comparison module 604 provides an output indicative of the frequency with which at least one threshold is exceeded. The power quality assessment module 606 is to determine, based on the output of the comparison module 604, the effect of the printer component(s) on at least one power quality measure of a power network connected to the printer.

Figure 7:
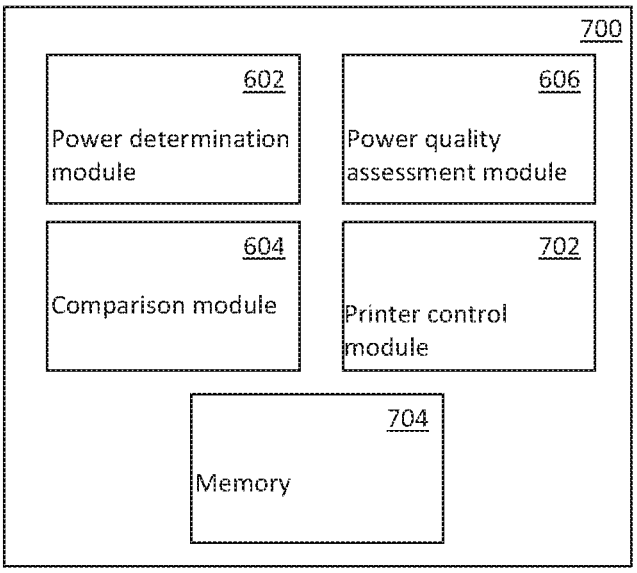

FIG. 7 shows a second example of a power monitor 700 for a printer. In addition to the components described in relation to FIG. 6, the power monitor 700 in this example also comprises a printer control module 702 and a memory 704 to store the power usage levels determined by the power determination module 602. In addition, while in the example of FIG. 6, the comparison module 604 compares the power usage levels to at least one threshold, in the example of FIG. 7, the comparison module 604 additionally compares the power quality measure to a standard (e.g. a predetermined threshold power quality measure). This determines whether the effect (or potential effect) of the printer component(s) on at least one power quality measure of a power network connected to the printer meets or fails to meet a predetermined standard(s). If the power quality measure fails to meet the standard (for example, a threshold value), the printer control module 702 is capable of controlling the printer 400 (for example by sending an instruction to a control module in the processor 408) to reduce its power consumption.

Figure 8:
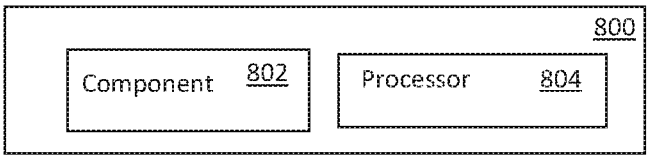
FIG. 8 is a schematic representation of a printer, according to one example.

FIG. 8 shows a power regulated printer 800 arranged to receive power from a connected power network. The printer 800 comprises a component 802 capable of affecting the power quality within the network. The printer 800 further comprises a processor 804 arranged, in use of the printer 800, to model the power usage of the component 802 in carrying out a print task by determining, based on a print instruction, the power usage of the component in carrying out the print task for each of a plurality of time intervals. The processor 804 is further arranged to determine, over a predetermined period, whether the power usage is such that it may cause a significant degradation in the power quality of the network and, if so, to reduce the power usage of the printer 802. The measure of a significant degradation may be in relation to a predefined standard. In one example, the degradation may be considered to be significant if it exceeds a threshold set in relation to $P_{ST}$, as defined by the IEC standards.

A power monitor 600; 700, or the modules 602, 604, 606, 702 thereof, may be a general purpose processing apparatus programmed to carry out the functions of the modules mentioned above. A processor 408, 804 may comprise a power monitor 600, 700. A processor 408, 804 may comprise a printer management module, arranged to carry out and control printing tasks. In one example the processing carried out by the modules 602, 604, 606, 702 is carried out by an Field Programmable Gate Array (FPGA) integrated circuit or chip, which may also or alternatively provide a processor 408, 804 in some examples.

It will be appreciated that the print instruction may be available before the printing task effected thereby is performed. To that end, it is possible to use the methods set out herein to predict the future flicker that could be caused to a power network 414, and, in some examples, to take steps to avoid this. In this way, in some examples, the printer 400, 800 may be controlled such that it stays within desirable limits in relation to power quality (for example, the limits set by the IEC) by controlling the printer 400, 800 appropriately. This avoids any need to make arrangements to protect the power network 414 from the adverse effects that the printer 400, 800 may otherwise cause, and allows for ease of connection of even high-speed printing apparatus into any suitable power network 414, including in some examples a domestic, or relatively low power, network outlet.

Examples in the present disclosure can be provided as methods, systems or machine readable instructions, such as any combination of software, hardware, firmware or the like. Such machine readable instructions may be included on a computer readable storage medium (including but is not limited to disc storage, CD-ROM, optical storage, etc.) having computer readable program codes therein or thereon.

The present disclosure is described with reference to flow charts and/or block diagrams of the method, devices and systems according to examples of the present disclosure. It shall be understood that each flow and/or block in the flow charts and/or block diagrams, as well as combinations of the flows and/or diagrams in the flow charts and/or block diagrams can be realized by machine readable instructions.

The machine readable instructions may, for example, be executed by a general purpose computer, a special purpose computer, an embedded processor or processors of other programmable data processing devices to realize the functions described in the description and diagrams. In particular, a processor or processing apparatus may execute the machine readable instructions. Thus the functional modules or functional units of the apparatus and devices may be implemented by a processor executing machine readable instructions stored in a memory, or a processor operating in accordance with instructions embedded in logic circuitry. The term 'processor' is to be interpreted broadly to include a CPU, processing unit, ASIC, logic unit, or programmable gate array etc. The methods and functional modules may all be performed by a single processor or divided amongst several processors.

Such machine readable instructions may also be stored in a computer readable storage that can guide the computer or other programmable data processing devices to operate in a specific mode.

Such machine readable instructions may also be loaded onto a computer or other programmable data processing devices, so that the computer or other programmable data processing devices perform a series of operation steps to produce computer-implemented processing, thus the instructions executed on the computer or other programmable devices provide a step for realizing functions specified by flow(s) in the flow charts and/or block(s) in the block diagrams.

Further, the teachings herein may be implemented in the form of a computer software product, the computer software product being stored in a storage medium and comprising a plurality of instructions for making a computer device implement the methods recited in the examples of the present disclosure.

Although the flow diagrams described above show a specific order of execution, the order of execution may differ from that which is depicted. Blocks described in relation to one flow chart may be combined with those of another flow chart.

While the method, apparatus and related aspects have been described with reference to certain examples, various modifications, changes, omissions, and substitutions can be made without departing from the spirit of the present disclosure. It is intended, therefore, that the method, apparatus and related aspects be limited only by the scope of the following claims and their equivalents. The features of any dependent claim may be combined with the features of any of the independent claims or other dependent claims.

The invention claimed is:

1. A power monitor for a printer comprising:

i. a power determination module to determine power usage requirements of at least one printer component in carrying out a print instruction, and to determine a power usage level of the at least one component for each of a plurality of time intervals;

ii. a comparison module to compare the power usage levels to at least one threshold; and iii. a power quality assessment module to determine, based on an output of the comparator module, the effect of the printer component(s) in carrying out the print instruction on at least one power quality measure associated with a power supply network connected to the printer.

2. A power monitor according to claim 1 in which the power quality measure is a measure of voltage flicker.

3. A power monitor according to claim 1 in which the comparison module is further arranged to compare the output of the power quality measure to a predetermined standard for the quality power measure.

4. A power monitor according to claim 3 which comprises a printer control module to control a printer to reduce power consumption if the power quality measure does not meet the predetermined standard.

5. A power monitor according to claim 1 which comprises an FPGA.

6. The power monitor according to claim 1, the comparison module to further determine, over a predetermined period, a number of occasions on which the power usage level exceeds the threshold.

7. A power regulated printer comprising the power monitor of claim 1, the printer arranged to receive power from a power supply network and to carry out a printing task, the printer further comprising i. a component capable of affecting the power quality within the power supply network, and ii. a processor to, in use of the printer, a) model the power usage of the component in carrying out a printing task by determining, based on a print instruction, the power usage of the component in carrying out the printing task for each of a plurality of time intervals;

b) determine, over a predetermined period, whether the power usage is such that it may cause a significant degradation of the power quality of the power supply network and, if so, reduce the power usage of the printer.

8. A power regulated printer according to claim 7 which the component is capable of contributing to voltage flicker in the power supply network.

9. A method for operating a power monitor for assessing power usage of a printer component in a printer, the power monitor comprising:

a power determination module to determine power usage requirements of the printer component in carrying out a print instruction, and to determine a power usage level of the component for each of a plurality of time intervals;

a comparison module to compare the power usage levels to a threshold power usage level; and a power quality assessment module to determine, based on an output of the comparator module, an effect of the printer component in carrying out the print instruction on a power quality measure associated with a power supply network connected to the printer;

the method comprising:

i. with the printer, receiving a print instruction, the print instruction being to cause the printer to carry out a printing task;

ii. with the power determination module, determining, based on the print instruction, a power usage level of the printer component in carrying out the print instruction; wherein the power usage level is determined for each of the plurality of time intervals;

iii. with the comparison module, determining, over a predetermined period, the number of occasions on which the power usage level in a time interval exceeds the threshold power usage level.

10. A method according to claim 9, further comprising, with the power quality assessment module, assessing a separate power usage level of each of a plurality of printer components, the printer components comprising a printhead assembly and a motor of the printer.

11. A method according to claim 9 which the printer is an ink jet printer and in which the step of determining the power usage level comprises determining the number of drops of ink ejected by at least one printhead of a printhead assembly in each of the plurality of time intervals.

12. A method according to claim 9 in which the printer is to receive power from a power supply network, and the number of occasions on which the power usage level in a time interval exceeds the threshold power usage level over the predetermined period is used by the power quality assessment module to determine a measure of the effect of the printer on power quality in the power supply network.

13. A method according to claim 12 in which the power quality measure is a measure of voltage flicker.

14. A method according to claim 12 which the effect on power quality is compared to a threshold and, if the threshold is exceed, the power usage of the printer is reduced.

15. A method according to claim 14 in which the power usage is reduced by causing the printer to operate at a reduced speed.

16. A method according to claim 14 in which the power usage is reduced by causing the printer to stop printing operations.

17. A power monitor for a printer comprising:

a power determination module to predict, based on a print instruction, a power usage requirement of a printer component in carrying out the print instruction, and to determine a power usage level of the component for each of a plurality of time intervals;

a comparison module to compare the power usage levels to a threshold;

a power quality assessment module to determine, based on an output of the comparator module, an effect of the printer component in carrying out the print instruction on a power quality measure associated with a power supply network connected to the printer; and a printer control module to selectively reduce the power usage level of the component during actual execution of the print instruction when the power quality assessment module indicates a negative effect on the power quality measure.

18. The power monitor according to claim 17, the comparison module to further determine, over a predetermined period, a number of occasions on which the power usage level exceeds the threshold.

19. The power monitor according to claim 17, the printer control module to reduce the power usage level of the component by slowing a printing speed.

20. The power monitor according to claim 17, the printer control module to reduce the power usage level of the component by temporarily pausing a printing process.

* * * * *